US006762209B1

(12) United States Patent
Neathery et al.

(10) Patent No.: US 6,762,209 B1
(45) Date of Patent: Jul. 13, 2004

(54) BUBBLE COLUMN APPARATUS FOR SEPARATING WAX FROM CATALYST SLURRY

(75) Inventors: James K. Neathery, Lexington, KY (US); Burtron H. Davis, Georgetown, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 0 days.

(21) Appl. No.: 10/233,743

(22) Filed: Sep. 3, 2002

Related U.S. Application Data

(60) Provisional application No. 60/316,776, filed on Aug. 31, 2001.

(51) Int. Cl.[7] ..... C07C 27/00
(52) U.S. Cl. ..... 518/700; 518/715
(58) Field of Search ..... 518/700, 715

(56) References Cited

U.S. PATENT DOCUMENTS

| | | | |
|---|---|---|---|
| 4,605,678 | A | 8/1986 | Brennan et al. |
| 5,520,890 | A | 5/1996 | Lorentzen et al. |
| 5,599,849 | A | 2/1997 | Jager et al. |
| 5,900,159 | A | 5/1999 | Engel et al. |
| 6,068,760 | A | 5/2000 | Benham et al. |
| 6,201,031 | B1 | 3/2001 | Steynberg et al. |
| 6,217,830 | B1 | 4/2001 | Roberts et al. |
| 6,462,098 | B1 * | 10/2002 | Vogel et al. ..... 518/700 |

OTHER PUBLICATIONS

Fan, Liang–shih. Gas–Liquid–Solid Fluidization Engineering. Butterworth Publishers, 1989, Massachussets.

Encyclopedia of Chemical Technology. Fourth Edition. vol. 10. 1994. Wiley–Interscience Publications.

R. Krishna et al. Design and Scale–up of the Fischer–Tropsch Bubble Column Slurry Reactor. Fuel Processing Technology. vol. 64. pp. 73–105.

* cited by examiner

*Primary Examiner*—J. Parsa
(74) *Attorney, Agent, or Firm*—King & Schickli, PLLC

(57) ABSTRACT

Novel methods and devices for production of liquid hydrocarbon products from gaseous reactants are disclosed. In one aspect, a method for separating a liquid hydrocarbon, typically a wax, from a catalyst containing slurry is provided, comprising passing the slurry through at least one downcomer extending from an overhead separation chamber and discharging into the bottom of a slurry bubble column reactor. The downcomer includes a cross-flow filtration element for separating a substantially particle-free liquid hydrocarbon for downstream processing. In another aspect, a method for promoting plug-flow movement in a recirculating slurry bubble column reactor is provided, comprising discharging the recirculating slurry into the reactor through at least one downcomer which terminates near the bottom of the reactor. Devices for accomplishing the above methods are also provided.

16 Claims, 3 Drawing Sheets

BUBBLE COLUMN APPARATUS FOR SEPARATING WAX FROM CATALYST SLURRY

This application claims the benefit of U.S. Provisional Patent Application Ser. No. 60/316,776 filed Aug. 31, 2001.

This invention was made with Government support under Dept. of Energy grant DE-FC26-FT40308. The Government may have certain rights in this invention.

TECHNICAL FIELD

The present invention relates to methods and devices for producing liquid hydrocarbon products, particularly heavier products such as waxes, from gaseous reactants in a reactor. More specifically, the invention relates to methods and devices for separating liquid hydrocarbon products produced by the Fischer-Tropsch reaction using a slurry bubble column reactor.

BACKGROUND OF THE INVENTION

As an alternative or supplement to refinement of fossil fuels, it is known to react synthesis gas or syngas (usually produced by steam reforming or partial oxidation of feedstocks such as natural gas), which comprises mainly CO and $H_2$, with a catalyst such as Fe or Co to produce a wide range of hydrocarbons. This process, known as Fischer-Tropsch synthesis, is a well-known process for conversion of synthesis gas to synthetic fuels and raw materials for the chemical industry. The process is versatile in that it may use any type of coal, natural gas, or similar carbon-containing feedstock as raw material, and similarly the product distribution may be altered as desired. The product stream from known methods and devices employing Fischer-Tropsch synthesis includes, but is not limited to, naphtha, diesel, waxes, steam, water, and alcohols.

Various devices for conducting Fischer-Tropsch synthesis are known in the art, including packed bed reactors, slurry reactors such as stirred tank slurry reactors, and slurry bubble column reactors. At present, the slurry bubble column reactor is most applicable to processes utilizing Fischer-Tropsch synthesis to produce synthetic fuels and the like on a commercial basis. The slurry bubble column reactor is advantageous in comparison to the fixed or packed bed reactor system due to improved heat transfer and mass transfer, maintenance of an isothermal temperature profile, and comparatively low capital and operating costs.

In obtaining product from a slurry bubble column reactor via Fischer-Tropsch synthesis, it is necessary to separate the product from the slurry containing catalyst in order to recycle the slurry/catalyst phase into the reactor. Advantageously, in order to maximize efficiency of such a system the recycling of slurry through the slurry bubble column reactor should assume plug flow characteristics, i.e. the slurry should pass through the length of the system at a constant velocity. Prior art systems have successfully extracted product from a slurry bubble column reactor, but at the cost of maintenance of plug-flow kinetics (thereby adversely affecting efficiency of the reactor). These prior art systems further require complicated mechanisms for separating liquid products from catalyst/slurry phases in a slurry bubble column reactor.

Thus, there is a need in the art for methods and devices for separating hydrocarbon products from a slurry bubble column reactor which simply and efficiently separate the desired liquid product from the slurry/catalyst phase, maximizing separation while minimizing slurry hold-up and catalyst losses during separation. There is further a need in the art for such methods and devices which promote and enhance plug-flow characteristics of the slurry bubble column reactor, thereby maximizing efficiency and predictability of the system.

SUMMARY OF THE INVENTION

In one aspect, the present invention provides, in a Fischer-Tropsch process for synthesizing a liquid hydrocarbon product from a gaseous reactant, a method for separating a substantially particle-free liquid hydrocarbon product from a slurry comprising a catalyst particle and a suspension liquid while substantially preventing depletion of catalyst particle from the slurry. The method comprises introducing the gaseous reactant into a reactor containing the slurry, and bubbling the gaseous reactant upwardly through the catalyst particle-containing slurry to form a reaction mixture comprising liquid and gaseous hydrocarbon product, catalyst particle-containing slurry, and unreacted gaseous reactant. The gaseous reactant may be introduced into the reactor at a flow rate of from about 1 to about 20 cm/s.

A gas distributor such as a sparger may be used to bubble the gaseous reactant, typically a synthesis gas, through the slurry. Any synthesis gas resulting from conventional processing may be utilized. Typically, the synthesis gas will comprise hydrogen and carbon monoxide in a ratio of from about 0.5 to about 3.0. Suitable catalysts for the present method are those known in the art for Fischer-Tropsch reactions, including iron-based, cobalt-based, zinc-based, ruthenium-based, any catalyst based on metals from Group 8 of the Periodic Table of the Elements, or any mixture thereof. Suitable catalyst particles will have a particle size of from about 1 to about 200 $\mu$m.

The reaction mixture is then passed reactor upwardly through one or more risers to discharge into a separator chamber. Typically, the separator chamber will be placed in a spaced vertical orientation with the reactor. Gaseous hydrocarbon product and unreacted gaseous reactant from the reaction mixture separate from the liquid hydrocarbon product and catalyst-containing slurry in the separator chamber, and may be removed from the separator chamber via a port and exit pipe. As is known in the art, a system of warm and cold traps may be included downstream of the exit pipe to remove wax and light oil products from the unreacted synthesis gas.

Advantageously, heavier liquid hydrocarbon products such as waxes and catalyst particle-containing slurry may be returned from the overhead separator chamber via a gravity feed to the reactor. It will be appreciated that the driving force for this recirculating flow is the difference in density between the fluid column in the riser, containing slurry and gas, and the fluid column returning to the reactor (slurry only). The liquid hydrocarbon product and slurry are returned to the reactor through at least one downcomer containing at least one cross-flow filtration element.

Typically, the cross-flow filtration element will be a device comprising a porous tube encapsulated within a shell, located within the downcomer. It will be appreciated that any suitable filter may be employed, such as a sintered metal filter, a ceramic filter, a fiber filter, a wire mesh filter, or any other suitable filtration material. Such cross-flow filtration devices are well known in the art (Kirk-Othmer Encyclopedia of Chemical Technology, 1993, Vol. 10, pages 841–847, incorporated herein by reference). The cross-flow filtration element may comprise a metal or ceramic sinter having a pore size of from about 0.05 μm to about 20 μm. In another embodiment, a wire mesh filter having multiple layers of mesh with variable mesh sizes (varying from coarse to finer mesh) may be used. Typically, a range of mesh sizes from about 20 to about 200 mesh is used.

Accordingly, substantially catalyst particle-free liquid hydrocarbon products (typically waxes) of the Fischer-Tropsch synthesis reaction employed herein may be axially withdrawn from the downcomer without interference with the recirculating flow described. Typically, the liquid hydrocarbon product and catalyst particle-containing slurry are passed through the downcomer at a velocity sufficient to prevent accumulation of catalyst particle on the filtration material due to the shear force provided by the slurry flow. Typically, the liquid hydrocarbon product and catalyst particle-containing slurry are passed through the downcomer at a velocity of from about 0.5 to about 100 M/min. The downcomer extends from a bottom of the separator chamber and discharges into the reactor, thereby returning slurry and catalyst to the reactor for continued use.

In another aspect, the present invention provides, in a process for synthesizing a liquid hydrocarbon product from a gaseous reactant by a Fischer-Tropsch reaction, a method for promoting plug-flow characteristics of a bubble column reactor system by establishing a natural convection loop. The method comprises essentially the steps summarized above. As noted, a recirculating flow is established, stimulated by the differences in density between the upwardly flowing mixture of synthesis gas, catalyst, and slurry, and the downward flow of liquid hydrocarbon product, catalyst, and slurry. As described above, the liquid hydrocarbon product (wax) and catalyst-containing slurry are transported from the overhead separator chamber to the reactor through a downcomer extending from the bottom of the separator chamber.

The downcomer discharges into the interior of the reactor, typically near the bottom of the reactor. Accordingly, catalyst and slurry are returned to the reactor and discharged near the bottom thereof. It will be appreciated that this feature of the method reduces the back-mixing effect of discharging the downwardly-flowing slurry into the upwardly flowing mixture of slurry/synthesis gas. Accordingly, the plug-flow nature of the reactor system is maintained. As will be described in greater detail herein, this feature provides substantial and surprising benefits over conventional slurry bubble column reactors and methods of using them. Preferably, the downcomer discharges into the bottom of the reactor at a distance sufficient to promote the desired plug flow properties of the system, without interfering with the entry of synthesis gas into the reactor. Typically, the downcomer discharges recirculating slurry into the interior of the reactor at a distance of from about 0.01 to about 0.1 M from its bottom surface.

To establish the desired recirculating flow, the gaseous reactant may be introduced into the reactor at a superficial velocity of from about 1 to about 20 cm/s. Typically, the reaction mixture flows upwardly through the reactor at a superficial velocity of from about 3 to about 15 cm/s, and liquid hydrocarbon product/slurry are returned through the downcomer at a velocity of from about 0.5 to about 100 M/min. To assure a consistent recirculation rate, the fluid level in the separator chamber may be maintained to provide a head space of from about 0.1 to about 0.5 fraction of the reactor height.

In yet another aspect of the present invention, a slurry bubble column reactor system for synthesizing a liquid hydrocarbon product and a gaseous hydrocarbon product from a gaseous reactant by a Fischer-Tropsch reaction is provided. Such slurry bubble column reactors, which utilize a slurry of Fischer-Tropsch catalyst and suspension liquid for converting gaseous reactants such as synthesis gas, are known in the art. The reactor system comprises a reactor, a gas distributor for delivering the gaseous reactant into a bottom of the reactor, and a separator chamber for separating gaseous hydrocarbon product and unreacted gaseous reactant from the liquid hydrocarbon product. Typically, the gas distributor selected is a conventional sparger.

The separator chamber is placed in a spaced vertical orientation with the reactor, and is connected thereto by a riser extending from a top of the reactor, thereby placing the reactor in fluid communication with the separator chamber. At least one port for removing the gaseous hydrocarbon product and unreacted gaseous reactant is typically provided in the separator chamber. At least one downcomer extending from a bottom of the separator chamber discharges into the interior of the reactor. Typically, the downcomer discharges near a bottom of the reactor. Each downcomer includes a cross-flow filtration element for separating a substantially particle free liquid hydrocarbon product from a downwardly flowing mixture of liquid hydrocarbon (typically a wax) and catalyst-containing slurry.

Desirably, an overhead level controller of a design known in the art may be connected to the overhead separator chamber to maintain a constant pressure head. A let-down valve actuated by the overhead level controller may meter filtered liquid hydrocarbon product into a storage tank. Accordingly, liquid level in the overhead separation chamber may be controlled by the filtration rate, and by the rate of formation of liquid hydrocarbon product (waxes). Pressure drop across the cross-flow filtration element media may be controlled by varying the storage tank pressure, which may vary from about 0 to about 100 psig. Typically, a tank pressure of 2 psig will be used.

Other objects and applications of the present invention will become apparent to those skilled in this art from the following description wherein there is shown and described a preferred embodiment of this invention, simply by way of illustration of the modes currently best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrates several aspects of the present invention and, together with the description, serves to explain the principles of the invention. In the drawing.

Reference will now be made in detail to the presently preferred embodiments of the invention, examples of which are illustrated in the accompanying drawing.

DETAILED DESCRIPTION OF THE INVENTION

As summarized above, the present invention relates to novel methods and devices for synthesizing a liquid hydrocarbon product from a gaseous reactant via a Fischer-Tropsch reaction. The methods of the present invention may be accomplished by various means which are illustrated in the examples below. These examples are intended to be illustrative only, as numerous modifications and variations will be apparent to those skilled in the art. In one aspect, the present invention provides a slurry bubble column reactor system for synthesizing a liquid hydrocarbon product and a gaseous hydrocarbon product from a gaseous reactant by a Fischer-Tropsch reaction.

EXAMPLE 1

Figure 1:
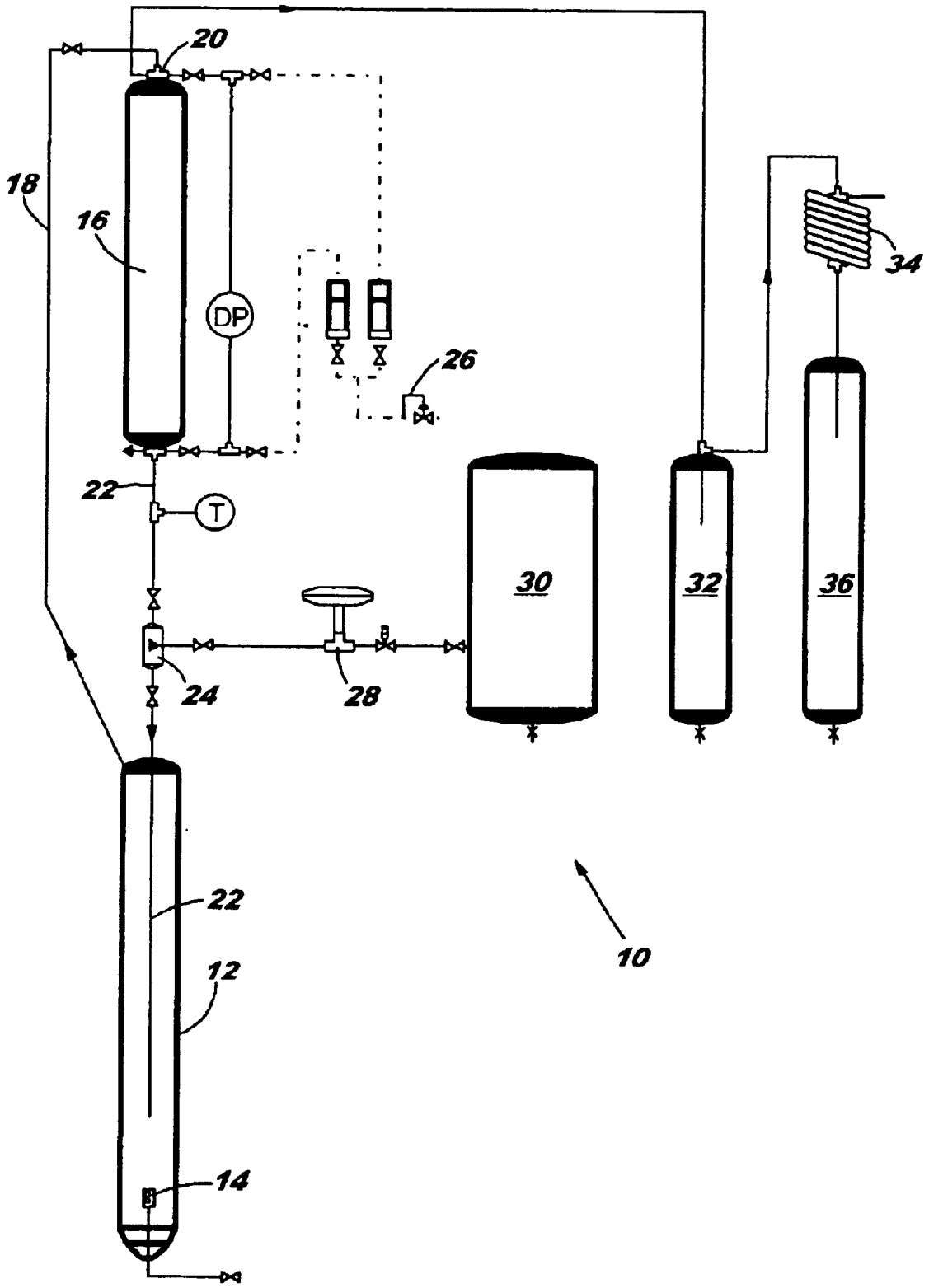
FIG. 1 is a schematic representation of the slurry bubble column reactor system of the present invention.

As shown schematically in FIG. 1, a reactor system 10 is provided comprising a reactor 12, a gas distributor 14 for delivering a gaseous reactant into a bottom of the reactor, and a separator chamber 16 for separating gaseous hydrocarbon product and unreacted gaseous reactant from the liquid hydrocarbon product. Typically, the gas distributor 14 selected is a conventional sparger.

The separator chamber 16 is placed in a spaced vertical orientation with the reactor 12, and is connected thereto by a riser 18 extending from a top of the reactor 12, thereby placing the reactor 12 in fluid communication with the separator chamber 16. A port 20 for removing gaseous hydrocarbon product and unreacted gaseous reactant is typically provided in the separator chamber 16. A downcomer 22 extending from a bottom of the separator chamber 16 discharges into the interior of the reactor 12. Typically, the downcomer 22 discharges near a bottom of the reactor 12. The downcomer 22 includes a cross-flow filtration element 24 for separating a substantially particle free liquid hydrocarbon product from a downwardly flowing mixture of liquid hydrocarbon (typically a wax) and catalyst-containing slurry.

Desirably, an overhead level controller 26 of a design known in the art may be connected to the overhead separator chamber 16 to maintain a constant pressure head. A let-down valve 28 actuated by the overhead level controller 26 may meter filtered liquid hydrocarbon product into a storage tank 30. Accordingly, filtration rate may be controlled by the overhead separation chamber 16 liquid level, and by the rate of formation of liquid hydrocarbon product (waxes). Pressure drop across the cross-flow filtration element 24 media may be controlled by varying the storage tank 30 pressure, which may be varied from about 0 to about 100 psig in accordance with the desired withdrawal rate of wax from the filtration element 24.

It will be appreciated that additional elements may be added to the reactor system 10 as shown in FIG. 1. For example, at least one warm trap 32, a cooler such as a chilled water cooling coil 34, and a cool trap 36 may be connected in series to recover gaseous hydrocarbon product and unreacted synthesis gas removed from the overhead separation chamber 16 for further processing and extraction of useful products. Such warm and cool traps and cooling coils are well known in the art.

In another aspect, the present invention provides a method for separating a liquid hydrocarbon product, typically a heavy wax, from a catalyst-containing slurry without depletion of catalyst during a Fischer-Tropsch process conducted in a slurry bubble column reactor. The invention further provides a method for promoting plug flow characteristics of the reactor system described in FIG. 1, thereby reducing back-mixing of catalyst-containing slurry during recirculation.

EXAMPLE 2

A slurry bubble column reactor was configured as shown in FIG. 1 to include a bubble column with a 5.08 cm diameter and a 2 meter height, with an effective reactor volume of 3.7 liters. The reactor was loaded with 2.8 liters (approximately 75% of capacity) of a slurry comprising 20 weight % iron-based Fischer-Tropsch catalyst and Shell $C_{30}$ oil. The catalyst was prepared as a high alpha iron-based catalyst from a 75 kg batch of a precursor spray-dried catalyst having a composition of 100 Fe/4.4 Si/1.0 K (atomic ratio). Approximately 750 kg of the final catalyst was prepared from the precursor by adding Cu and K promoters. The final analyzed catalyst composition was 100 Fe/5.1 Si/2.0 Cu/5 K (atomic ratio).

An additional 1.3 liters of $C_{30}$ oil were added to the overhead separation chamber. The reactor was pressurized with flowing CO gas at 175 psig (12 atm.), and the slurry was brought to an activation temperature of 230° C. at a rate of 50° C./hour. Upon stabilization of the reactor temperature, gas exiting from the separation chamber was monitored for $CO_2$ content to observe activation progress.

During the activation period, the downcomer from the overhead separation chamber to the reactor was valved off to isolate catalyst in the reactor. The downcomer included a filter tube (Mott Metallurgical Corp.) installed below the separator chamber, comprising a flow-through filter tube having a sintered metal (average pore size 2–5 $\mu$m) filter element.

After the catalyst had been activated for 24 hours, hydrogen gas flow was phased in with the CO feed gas. A $H_2$:CO ratio of 0.7 was maintained. Upon achieving a desired gas space velocity of 3 SLPH/g Fe, the downcomer was opened to allow circulation between the reactor, riser, and downcomer back to the reactor. Slurry flow rate (2 L/min or an axial velocity of 0.7 M/min.) prevented accumulation of catalyst on the filter media. The pressure drop across the filter was maintained by varying the wax storage tank pressure. Samples were taken, and syngas, CO, and $H_2$ conversions were calculated daily to assess reactor performance. Vapor products and unreacted synthesis gas were allowed to exit the separator chamber, and were passed through a warm trap (100° C.) and a cold trap (3° C.). A dry flow meter downstream of the cold trap measured exit gas flow rate.

The slurry volume in the separator chamber was monitored continuously by measuring differential pressure across the height of the chamber. Volume was maintained at 1.3 liters by removing wax from the reactor system through the filter element using a level control valve, with the wax being transported to the storage tank. Unfiltered slurry returned to the reactor through the downcomer, exiting near the bottom of the reactor without interfering with the entry of gaseous reactant via the sparger. Samples of unfiltered slurry were obtained from the separator chamber for monitoring wax product composition and catalyst mechanical attrition, measured as particle size distribution using a light scattering technique by a Cilas 1064 liquid/particle analyzer in accordance with the manufacturer's directions. The results obtained by the slurry bubble column reactor system were compared to results obtained from a conventional continuously stirred tank reactor system, using the same reactants and operating conditions.

Figure 2:
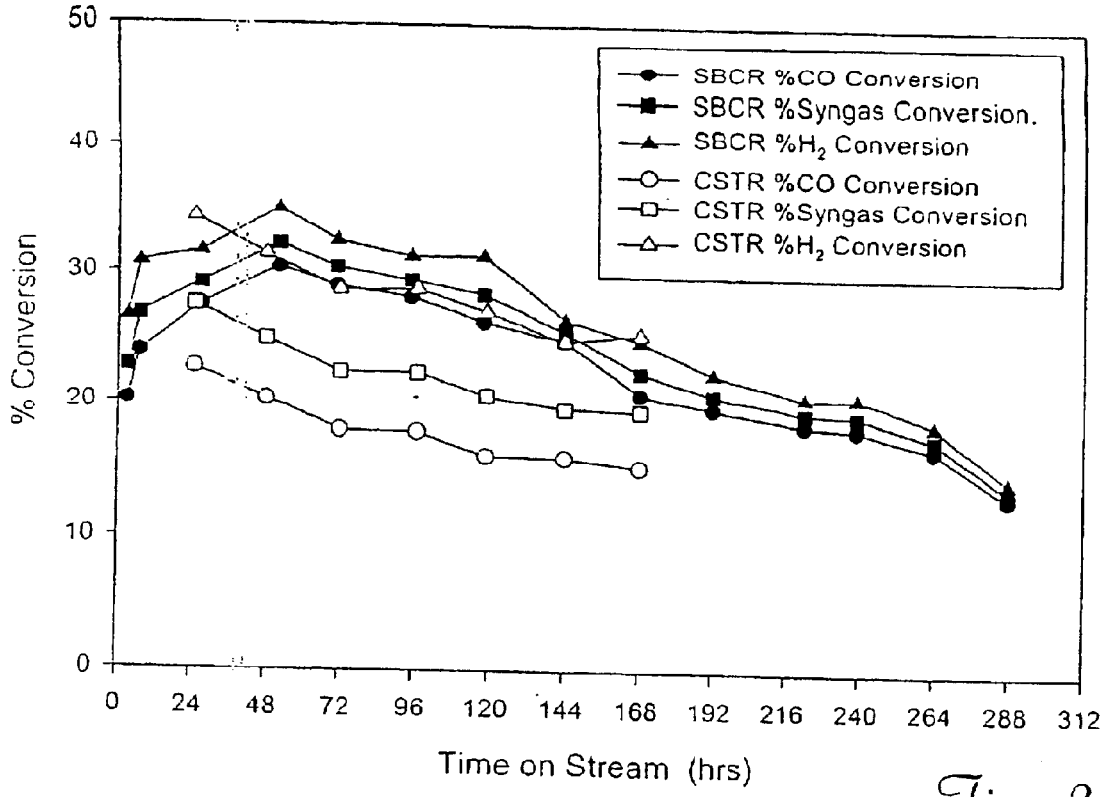
FIG. 2 shows a conversion comparison between the slurry bubble column reactor of this invention and a continuously stirred tank reactor system. Starting conditions were: 230° C., pressure=175 psig, $H_2$:CO ratio 0.7, SV=5.0 slph/g Fe.

As seen in FIG. 2, maximum gas conversions were achieved using the method and device of this invention after 50 hours of time on-stream. After this catalyst initiation period, synthesis gas conversion declined steadily to about 14% of initial values after 288 hours time on-stream. In contrast, maximum conversions in the continuously stirred tank reactor were achieved after only 24 hours time on-stream, and overall synthesis gas conversion was less than for the present invention.

Figure 3:
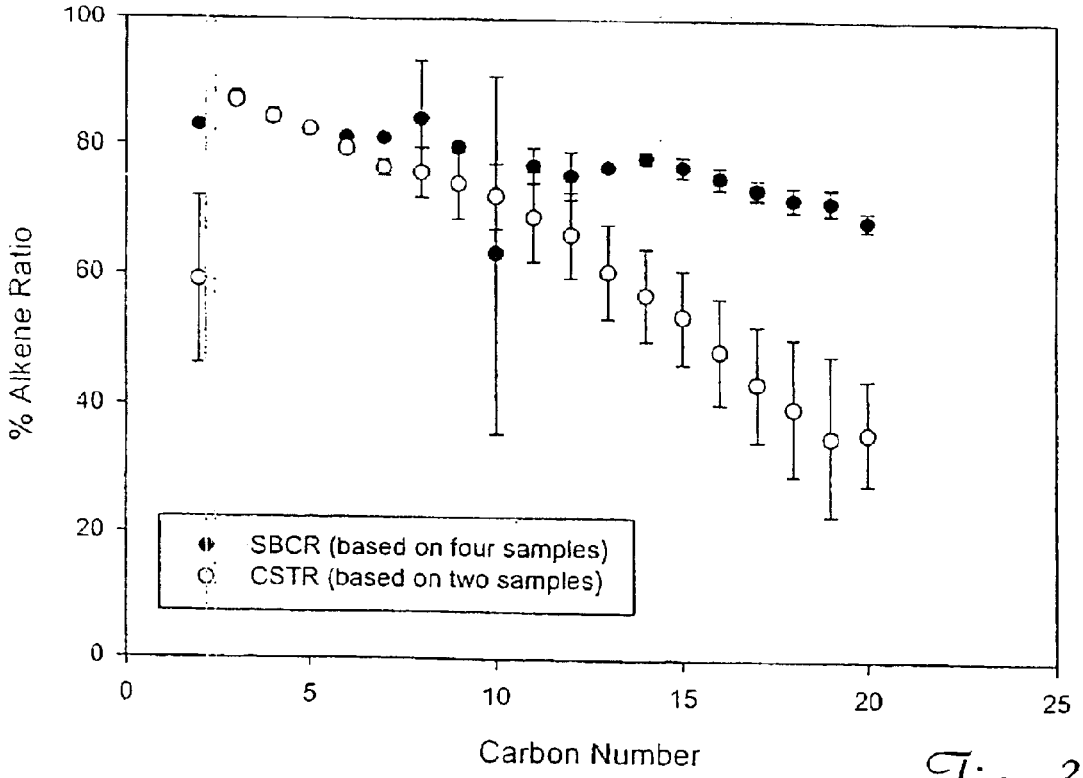
FIG. 3 shows the relative ratio of alkenes produced from the slurry bubble column reactor of this invention and a continuously stirred tank reactor system.

Weight percent distribution of Fischer-Tropsch reaction products are shown in Table 1. Surprisingly, beyond carbon number 10 the products obtained using the method and device of this invention were considerably more olefinic than the continuously stirred tank reactor, as shown also in FIG. 3. While not wishing to be bound by any theory, it is believed that this beneficial effect results from the plug flow nature of the present invention, conferred by the location at which the downcomer from the separator chamber discharges into the reactor. The improved conversion achieved by the present invention as described above also may promote the formation of heavier alkenes. The plug flow effect is shown schematically in FIGS. 4*a* and 4*b*.

| Product group | C range | Continuously stirred tank reactor (wt %) | Slurry bubble column reactor (wt %) |
|---|---|---|---|
| Light gas | $C_1$ | 4.8 ± 1.8 | 2.2 ± 0.8 |
| Gas | $C_1$ to $C_4$ | 19.7 ± 4.1 | 13.1 ± 4.4 |
| Gasoline | $C_5$ to $C_{11}$ | 31.0 ± 8.1 | 23.8 ± 8.6 |
| Diesel | $C_{12}$ to $C_{18}$ | 17.2 ± 2.6 | 27.2 ± 4.7 |
| Wax | $C_{19}$ and above | 27.3 ± 11.3 | 33.7 ± 14.1 |
| | $C_{12}$ and above | 44.5 ± 13.9 | 60.9 ± 12.3 |
| | $C_5$ and above | 75.5 ± 5.9 | 80.85 ± 5.2 |

Figure 4A:
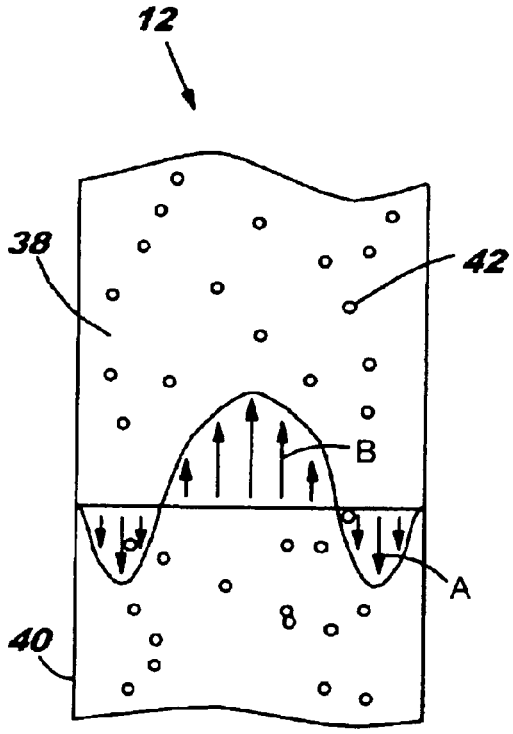
FIG. 4 shows schematically the flow characteristics of slurry bubble column reactors without (FIG. 4*a*) and with (FIG. 4*b*) a downcomer exiting from an overhead separator chamber and discharging near the bottom of the reactor.
Figure 4B:
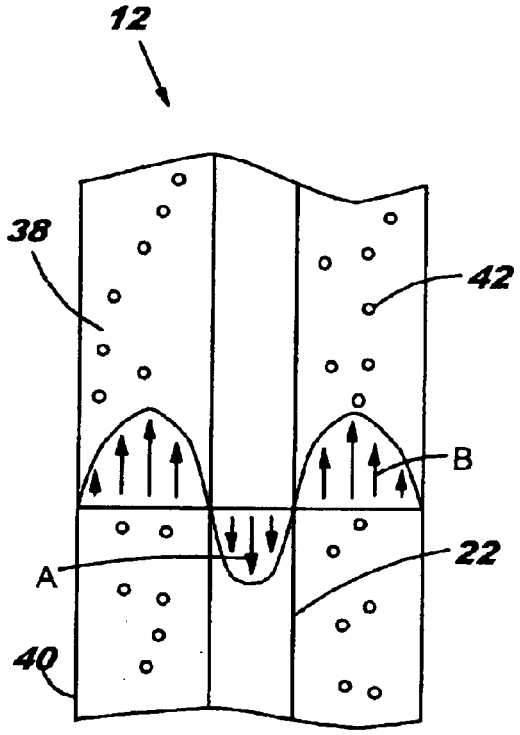

FIG. 4*a* shows the internal liquid slurry flow profile with a conventional slurry bubble column reactor system without the downcomer as described for the present invention. Flow of the slurry phase 38 along a wall 40 of the reactor 12 tends to be in the downward direction A due to wall 40 effects. Gas bubbles 42 pull liquid slurry 38 in the upward direction B near the centerline of the reactor 12. In contrast, a slurry bubble column reactor outfitted with a downcomer 22 discharging near the bottom of the reactor 12 avoids this effect. All slurry 38 flowing in the downward direction A is confined to the downcomer 22. Consequently, upward movement (in direction B) of the slurry 38 in contact with gas bubbles 42 is plug-flow in nature.

Accordingly, the method and device of the present invention provides a reliable, effective means for achieving separation of products of Fischer-Tropsch synthesis, in particular heavier products such as waxes, olefins, heavier alkenes, and the like, from a conventional catalyst-containing slurry. The system desirably exhibits properties of a plug-flow reactor, i.e. maintenance of a substantially even flow rate, thereby improving efficiency of the system and, surprisingly, beneficially altering the ratio of products produced.

The foregoing description of preferred embodiments of the invention has been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. In a Fischer-Tropsch process for synthesizing a liquid hydrocarbon product from a gaseous reactant, a method for separating a substantially particle-free liquid hydrocarbon product from a slurry comprising a catalyst particle and a suspension liquid while substantially preventing depletion of said catalyst particle from said slurry, the method comprising the steps of:

introducing the gaseous reactant into a reactor containing said catalyst particle-containing slurry;

bubbling the gaseous reactant upwardly through the catalyst particle-containing slurry to form a reaction mixture comprising liquid and gaseous hydrocarbon product, catalyst particle-containing slurry, and unreacted gaseous reactant;

passing the reaction mixture from the reactor upwardly through at least one riser to discharge into a separator chamber placed in a spaced vertical orientation with the reactor;

removing the gaseous hydrocarbon product and unreacted gaseous reactant from the reaction mixture from a top of the separator chamber;

returning the liquid hydrocarbon product and catalyst particle-containing slurry in a downward direction from the separator chamber to the reactor through at least one downcomer containing a cross-flow filtration element, said downcomer extending from a bottom of the separator chamber and discharging into the reactor; and axially passing said liquid hydrocarbon product through said cross-flow filtration element to obtain a substantially particle-free liquid hydrocarbon product.

2. The method of claim 1, wherein said downcomer discharges near a bottom of the reactor to substantially prevent interference with the upward flow of the reaction mixture.

3. The method of claim 1, wherein said liquid hydrocarbon product is a wax.

4. The method of claim 1, wherein said liquid hydrocarbon product and catalyst particle-containing slurry are passed through the downcomer at a flow rate sufficient to prevent accumulation of said catalyst particle on said cross-flow filtration element.

5. The method of claim 1, wherein said gaseous reactant is a synthesis gas comprising hydrogen and carbon monoxide having a $H_2$:CO ratio of from about 0.5 to about 3.0.

6. The method of claim 1, wherein said catalyst particle is selected from the group of Fischer-Tropsch catalysts consisting of an iron-based catalyst, a cobalt-based catalyst, a zinc-based catalyst, a ruthenium-based catalyst, a Group 8 metal-based catalyst, and any mixture thereof, said catalyst particle having a particle size of from about 1 to about 200 $\mu$m.

7. The method of claim 1, wherein said gaseous reactant is introduced into the reactor at a superficial velocity of from about 1 to about 20 cm/s.

8. The method of claim 1, wherein said cross-flow filtration element comprises a metal or ceramic sinter having a pore size of from about 0.05 $\mu$m to about 20 $\mu$m.

9. The method of claim 1, wherein said cross-flow filtration element comprises a wire mesh filter having a plurality of mesh screens of varying mesh size from about 20 mesh to about 200 mesh.

10. The method of claim 4, wherein said liquid hydrocarbon product and catalyst particle containing slurry are passed through the downcomer at a velocity of from about 0.5 to about 100 M/min.

11. In a process for synthesizing a liquid hydrocarbon product from a gaseous reactant by a Fischer-Tropsch reaction, a method for promoting plug-flow characteristics of a bubble column reactor system by establishing a natural convection loop, the method comprising the steps of:

bubbling the gaseous reactant upwardly through a slurry comprising a catalyst particle and a suspension liquid in the bubble column reactor to convert the gaseous reactant into a liquid hydrocarbon wax product, thereby establishing an upward flow in the reactor of a reaction mixture comprising the wax and a gaseous hydrocarbon product, the catalyst particle-containing slurry, and unreacted gaseous reactant;

allowing the reaction mixture to pass upwardly through at least one riser to discharge into a separator chamber placed in a spaced vertical orientation with the reactor;

allowing the gaseous hydrocarbon product and unreacted gaseous reactant to exit from a top of the separator chamber; and returning the catalyst particle-containing slurry in a downward direction from the separator chamber to an interior of the reactor through at least one downcomer, said downcomer extending from a bottom of the separator chamber and discharging near a bottom of the reactor to substantially prevent interference with the upward flow of the reaction mixture due to back mixing.

12. The method of claim 11, wherein said downcomer discharges said slurry into the interior of the reactor at a distance of from about 0.01 to about 0.1 M from a bottom surface of said reactor.

13. The method of claim 11, wherein said gaseous reactant is introduced into the reactor at a superficial velocity of from about 1 to about 20 cm/s.

14. The method of claim 11, wherein the reaction mixture flows upwardly through the reactor at a superficial velocity of from about 3 to about 20 cm/s.

15. The method of claim 11, wherein a fluid level in said separator chamber is maintained to provide a head space of from about 0.01 to about 0.5 fraction of a height of said reactor.

16. The method of claim 11, wherein said liquid hydrocarbon product and catalyst particle containing slurry are passed through the downcomer at a velocity of from about 0.5 to about 100 M/min.

* * * * *